US007580016B2

(12) United States Patent
Kim et al.

(10) Patent No.: US 7,580,016 B2
(45) Date of Patent: Aug. 25, 2009

(54) BACKLIGHT UNIT AND LIQUID CRYSTAL DISPLAY DEVICE USING THE SAME

(75) Inventors: Byoung Chul Kim, Gyeongsangbuk-do (KR); Yeon Taek Yoo, Cheongiu-si (KR)

(73) Assignee: LG. Display Co., Ltd., Seoul (KR)

( * ) Notice: Subject to any disclaimer, the term of this patent is extended or adjusted under 35 U.S.C. 154(b) by 646 days.

(21) Appl. No.: 11/208,238

(22) Filed: Aug. 17, 2005

(65) Prior Publication Data

US 2006/0285032 A1 Dec. 21, 2006

(30) Foreign Application Priority Data

Jun. 17, 2005 (KR) ..... 10-2005-0052663

(51) Int. Cl.
*G09G 3/36* (2006.01)

(52) U.S. Cl. ..... 345/83; 345/84

(58) Field of Classification Search ..... 345/87, 345/102, 39, 82–84, 204
See application file for complete search history.

(56) References Cited

U.S. PATENT DOCUMENTS 6,087,786 A * 7/2000 Allen et al. ..... 315/291
6,429,839 B1 * 8/2002 Sakamoto ..... 345/87
6,445,143 B1 * 9/2002 Min ..... 315/307
6,750,842 B2 * 6/2004 Yu ..... 345/102
7,196,804 B2 * 3/2007 Yamazaki et al. ..... 358/1.15
2003/0038770 A1 * 2/2003 Lee et al. ..... 345/102
2003/0230991 A1 * 12/2003 Muthu et al. ..... 315/307
2004/0179003 A1 * 9/2004 Jang ..... 345/204

FOREIGN PATENT DOCUMENTS

JP 02-097916 4/1990

(Continued)

OTHER PUBLICATIONS

First Office Action issued in corresponding Chinese Patent Application No. 200510093826.8, issued on Feb. 29, 2008.

(Continued)

*Primary Examiner*—Amare Mengistu
*Assistant Examiner*—Koosha Sharifi
(74) *Attorney, Agent, or Firm*—Brinks Hofer Gilson & Lione

(57) ABSTRACT

A backlight unit includes a light source part having red, green and blue light sources and a light source controller to generate a common control wave and to drive each of the red, green and blue light sources by use of a dimming signal from the outside and the common control wave. The light source controller may include a pulse width modulation controller. The common control wave may have a triangular shape. Each of the red, green and blue light sources is driven with the common triangular wave which is generated by a triangular wave generator. The size of the light source controller may be reduced and flickers may be substantially reduced.

9 Claims, 7 Drawing Sheets

FOREIGN PATENT DOCUMENTS

| | | | |
|---|---|---|---|
| JP | 11-191496 | | 7/1999 |
| JP | 2002-56997 | A | 2/2002 |
| JP | 2002-569974 | A | 2/2002 |
| JP | 2002-111786 | | 4/2002 |
| JP | 2002-350846 | | 12/2002 |
| JP | 2004-290508 | | 10/2004 |
| JP | 2004-341429 | | 12/2004 |

OTHER PUBLICATIONS

First Office Action issued in corresponding Japanese Patent Application No. 2005-297714; issued Apr. 15, 2008.
Office Action issued in corresponding Korean Patent Application No. 200510093826.8; issued Feb. 29, 2008.
Office Action issued in corresponding Japanese Patent Application No. 2005-297714; issued Sep. 9, 2008.

* cited by examiner

BACKLIGHT UNIT AND LIQUID CRYSTAL DISPLAY DEVICE USING THE SAME

This application claims the benefit of the Korean Patent Application No. P2005-52663 filed on Jun. 17, 2005, which is hereby incorporated by reference in its entirety.

BACKGROUND

1. Technical Field

The invention relates to a backlight unit, and more particularly to a backlight unit having reduced flickers.

2. Related Art

A liquid crystal display (hereinafter, referred to as "LCD") device is frequently used due to characteristics of lightness, slimness, low driving power consumption and so on. The LCD device is used in various fields such as office automation equipment, audio/video equipment, etc. The LCD device controls the transmitted amount of light beam in accordance with a video signal applied to a plurality of control switches which are arranged in a matrix shape. As a result, a desired picture is displayed on a screen.

The LCD device is not a self luminous display device, and it requires a light source such as a backlight. A backlight unit for use with the LCD device includes red, green and blue light sources that emit red light, green light and blue light, respectively. The red, green and blue lights are mixed to generate a white light.

The red, green and blue light sources may be controlled by a pulse width modulation controller (hereinafter, "PWM controller"). The PWM controller includes three separate and individual controllers that control the red light source, the green light source and the blue light source, respectively. The PWM controller may be large in size because of the separate red, green and blue PWM controllers. Further, the PWM controller generates separate control waves that drive the red light source, the green light source and the blue light source. The control waves may not be synchronized, and as a result, red, green and blue light emitting driving signals Rds, Gds and Bds are not synchronized as shown in FIG. 1. Flickers may generate due to the asynchronous drive timing of the red, green and blue light sources. Accordingly, there is a need of a backlight unit that overcome drawbacks of the related art backlight unit.

SUMMARY

By way of introduction only, in one embodiment, a backlight unit includes a light source part having a plurality of light sources and a light source controller to generate a common control wave and drive each of the plurality of light sources based on a dimming signal and the common control wave.

In other embodiment, a liquid crystal display device includes a liquid crystal display panel which displays a picture by controlling light transmittance and a backlight unit which generates a common control wave. The backlight unit drives red, green and blue light sources with a dimming signal and the common control wave. The backlight unit irradiates the liquid crystal display panel with light.

BRIEF DESCRIPTION OF THE DRAWINGS

These and other objects of the invention will be apparent from the following detailed description of embodiments with reference to the accompanying drawings, in which.

DETAILED DESCRIPTION OF THE PREFERRED EMBODIMENT

Reference will now be made in detail to embodiments, examples of which are illustrated in the accompanying drawings.

Figure 1:
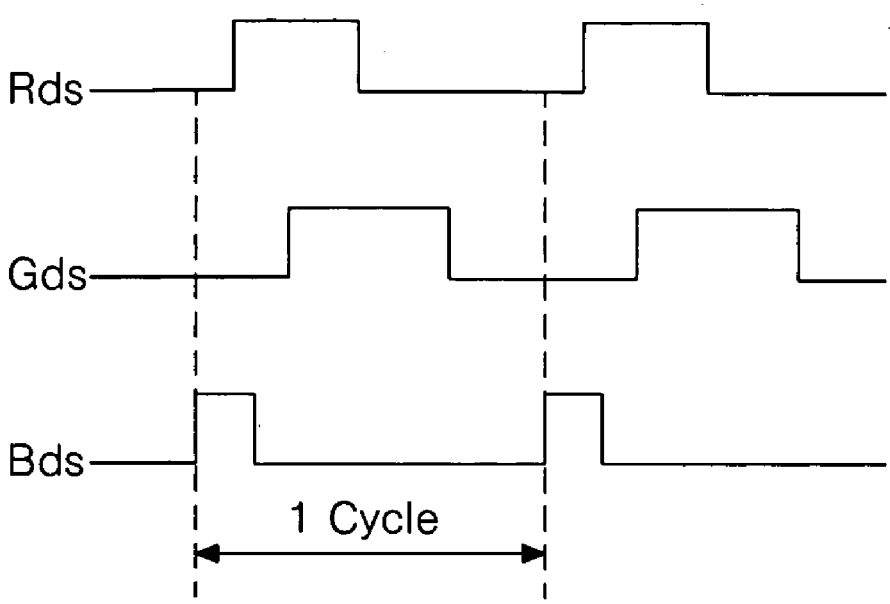
FIG. 1 RELATED ART
FIG. 1 illustrates an asynchronous drive waveform driving red, green and blue light sources.
Figure 2:
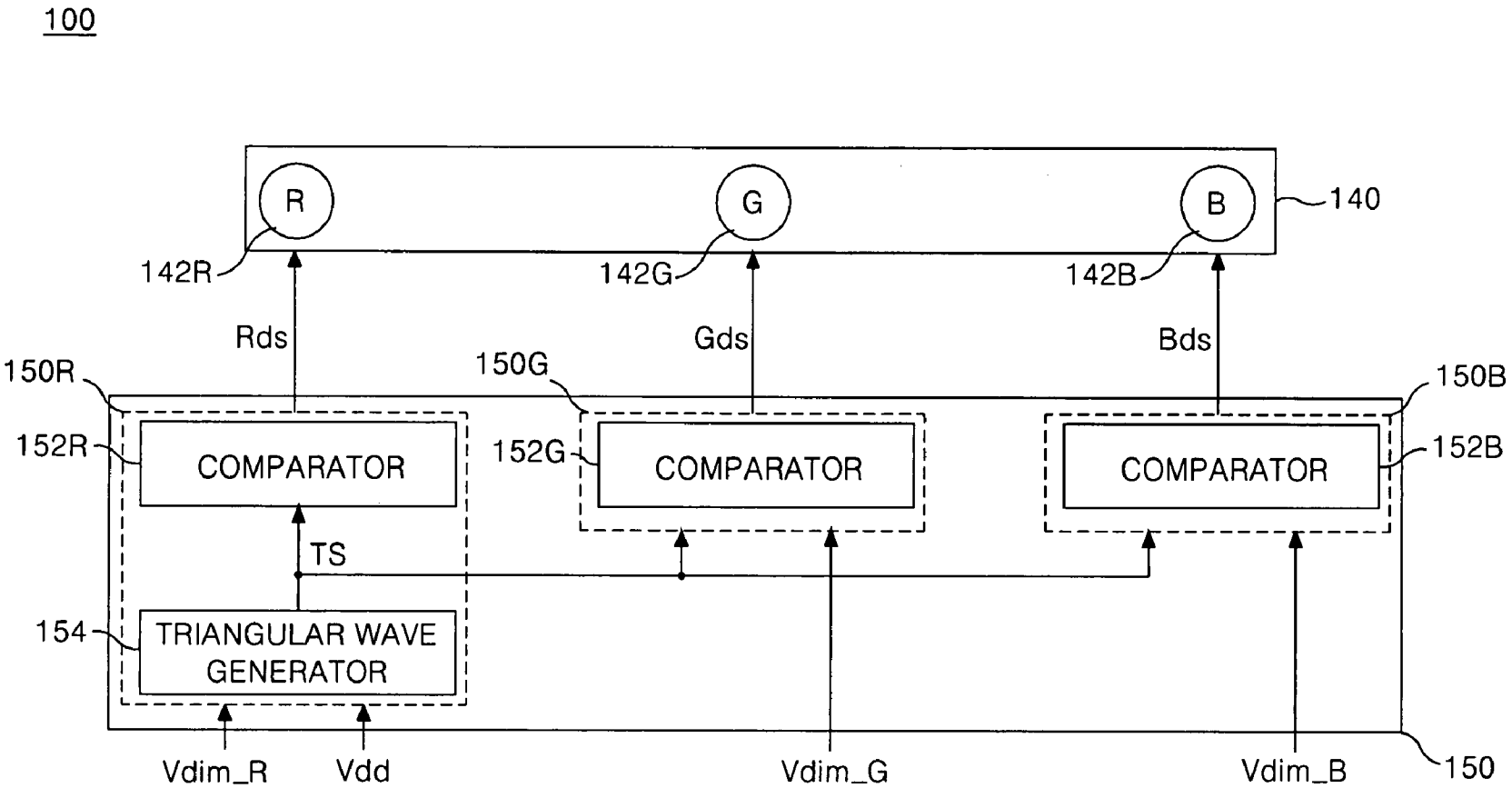
FIG. 2 is a block diagram of a backlight unit according to one embodiment.

FIG. 2 is a diagram of a backlight unit 100 according to one embodiment. The backlight unit 100 includes a light source part 140 having red, green and blue light sources 142R, 142G, 142B, and a pulse width modulation PWM controller 150 to drive the red, green and blue light sources 142R, 142G and 142B by use of a common control wave TS and dimming signals Vdim_R, Vdim_G and Vdim_B. The common control wave TX may have a triangular shape, as illustrated in FIG. 3.

The red light source 142R is a red light emitting diode which emits a red color R. The red light source 142R emits light in accordance with a red light emitting driving signal Rds from the PWM controller 150 to radiate the red light. The green light source 142G is a green light emitting diode which emits a green color G. The green light source 142G emits light in accordance with a green light emitting driving signal Gds from the PWM controller 150 to radiate the green light. The blue light source 142B is a blue light emitting diode which emits a blue color B. The blue light source 142B emits light in accordance with a blue light emitting driving signal Bds from the PWM controller 150 to radiate the blue light. The light source part 140 mixes the red R, green G and blue B lights from the respective red, green and blue light sources 142R, 142G and 142B to generate a white light.

The PWM controller 150 includes a common triangular wave generator 154 to generate the common triangular wave TS, and a red PWM controller 150R to drive the red light source 142R by use of the common triangular wave TS and the red dimming signal Vdim_R. The PWM controller 150 further includes a green PWM controller 150G to drive the green light source 142G by use of the common triangular wave TS and the green dimming signal Vdim_G, and a blue PWM controller 150B to drive the blue light source 142B by use of the common triangular wave TS and the blue dimming signal Vdim_B.

Figure 3:
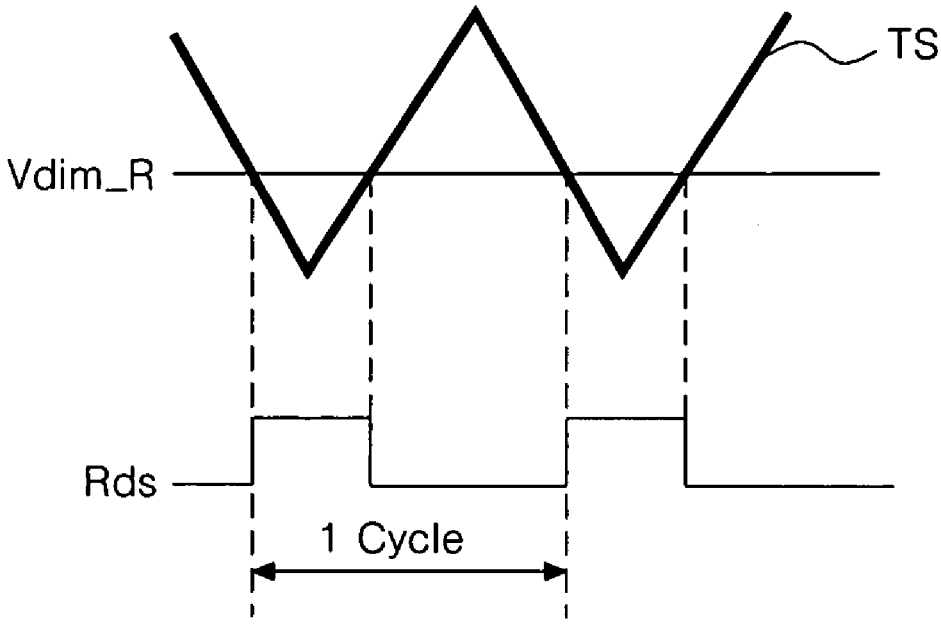
FIG. 3 illustrates a drive waveform of the backlight unit shown in FIG. 2.

The common triangular wave generator 154 includes an operational amplifier and generates the common triangular wave Ts as shown in FIG. 3. The construction of the common triangular wave generator 154 will be described in detail in conjunction with FIG. 6. The common triangular wave generator 154 commonly supplies the generated common triangular wave TS to each of the red, green and blue PWM controllers 150R, 150G, 150B. The common triangular wave generator 154 may be embedded in one of the red, green and blue PWM controllers 150R, 150G, 150B.

In this embodiment, the red PWM controller 150R includes a red comparator 152R to generate the red light emitting driving signal Rds by use of a red dimming signal Vdim_R and the common triangular wave TS from the common triangular wave generator 154. The generated red light emitting driving signal Rds is supplied to the red light source 142R.

The green PWM controller 150G includes a green comparator 152G to generate the green light emitting driving signal Gds, which has a different pulse width from the red light emitting driving signal Rds, by use of a green dimming signal Vdim_G and the common triangular wave TS from the common triangular wave generator 154. The generated green light emitting driving signal Gds is supplied to the green light source 142G in the same manner as the red comparator 152R.

The blue PWM controller 150B includes a blue comparator 152B to generate the blue light emitting driving signal Bds, which has a different pulse width from the green light emitting driving signal Gds, by use of a blue dimming signal Vdim_B and the common triangular wave TS from the common triangular wave generator 154. The generated blue light emitting driving signal Bds is supplied to the blue light source 142B in the same manner as the red comparator 152R.

In the backlight unit 100, the red, green and blue light sources 142R, 142G and 142B emit light based on the red, green and blue light emitting driving signals Rds, Gds and Bds. The backlight unit 100 mixes the red, green and blue lights from the light source part 140 to generate the white light. In this way, the backlight unit 100 drives each of the red, green and blue light sources 142R, 142G, 142B with the common triangular wave TS from one triangular wave generator 154. As a result, the size of the PWM controller 150 may be reduced.

Figure 5:
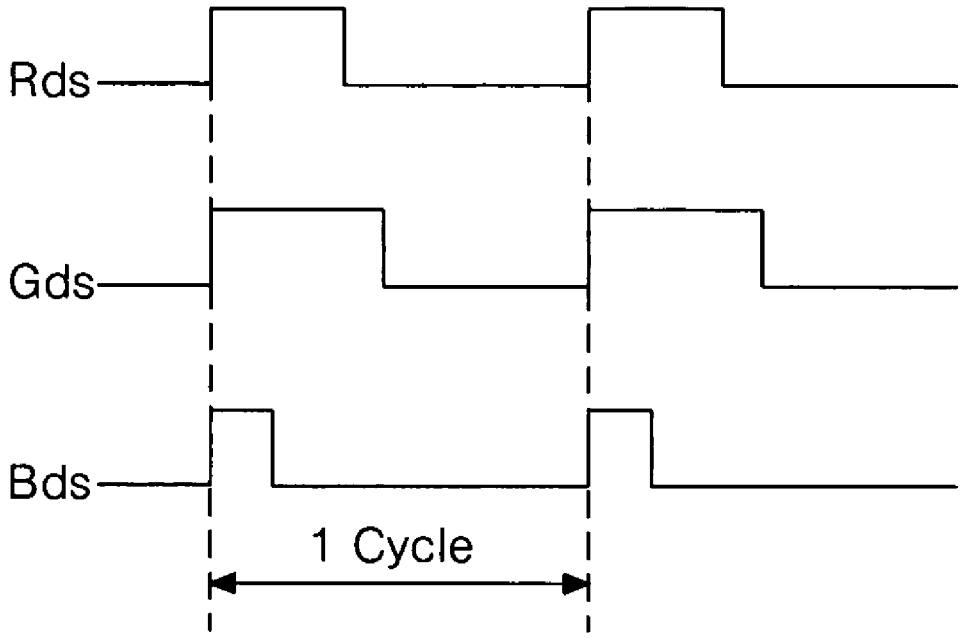
FIG. 5 illustrates a synchronized drive waveform driving red, green and blue light sources.

The backlight unit 100 may have the red, green and blue light emitting driving signals Rds, Gds, Bds synchronized as shown in FIG. 5. Each of the red, green and blue PWM controllers 150R, 150G, 150B performs the pulse-width modulation with the common triangular wave TS from the common triangular wave generator 154 to generate each of the red, green and blue light emitting driving signals Rds, Gds, Bds. Accordingly, the backlight unit 100 may prevent flickers which are generated due to the asynchronization of the red, green and blue light emitting driving signals Rds, Gds, Bds.

Figure 6:
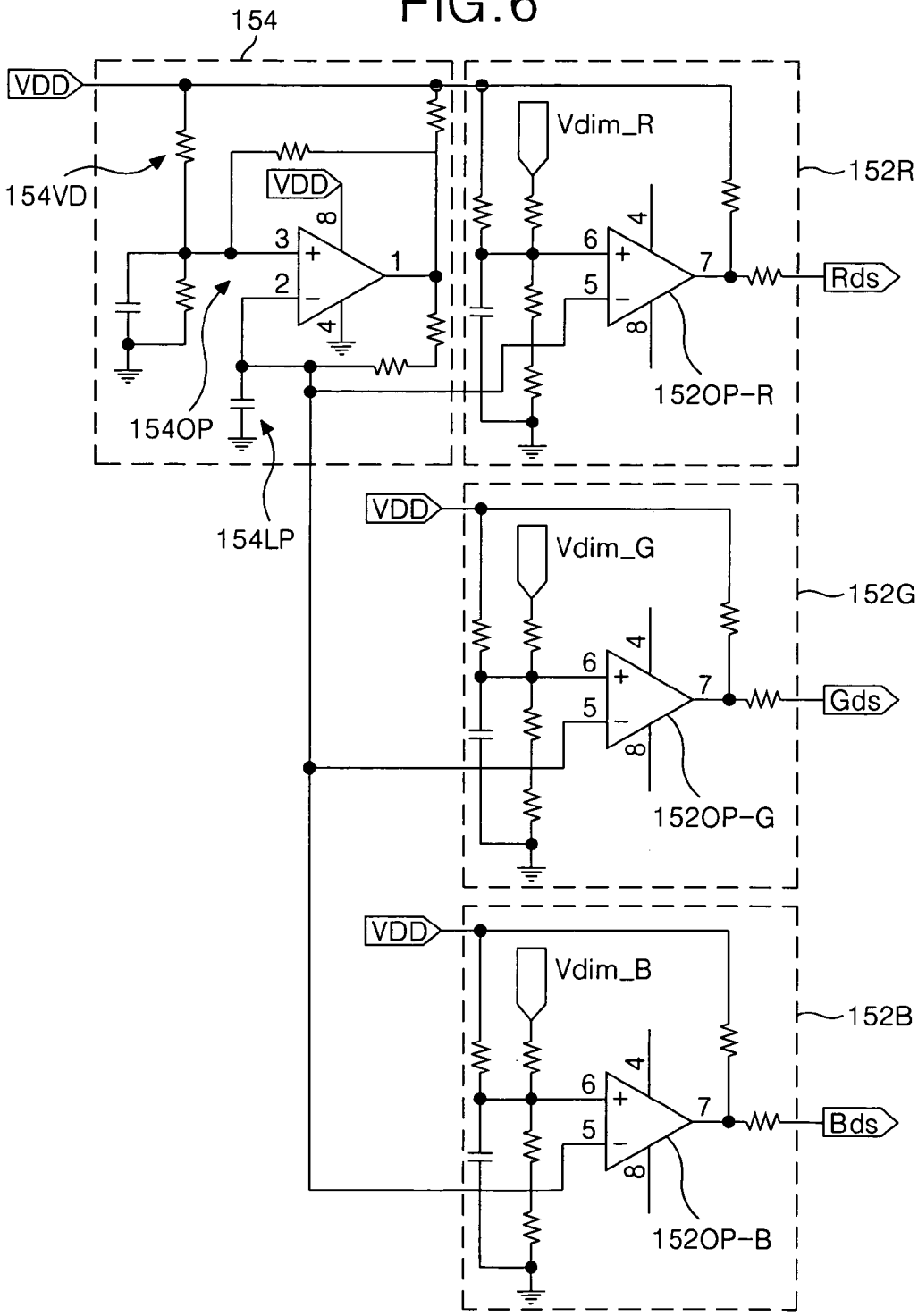
FIG. 6 is an exemplary circuit diagram of the backlight unit of FIG. 2.

FIG. 6 illustrates an exemplary circuit diagram of the PWM controller 150 of FIG. 2. As noted above, the PWM controller 150 includes the common triangular wave generator 154 and the red comparator 152R, the green comparator 152G and the blue comparator 152B. The common triangular wave generator 154 includes an operational amplifier 154OP that outputs a pulse waveform as a result of comparison between a ground voltage and VDD divided by a voltage divider 154VD. A low pass filter 154LP operates to filter the pulse waveform to form a triangular waveform. As shown in FIG. 6, the triangular waveform output from the common triangular wave generator 154 is commonly supplied to the red, green and blue comparators 152R, 152G and 152B. In each comparator, the dimming signals Vdim_R, Vdim_G and Vdim_B are input to a positive terminal of operational amplifiers 152OP-R, 152OP-G and 152OP-B. The common triangular wave is supplied to a negative terminal of the operational amplifiers 152OP-R, 152OP-G and 152OP-B. Due to the differences in the dimming signals, Vdim_R, Vdim_G and Vdim_B, red, green and blue light emitting driving signals Rds, Gds, Bds are output, respectively. The red, green and blue light emitting driving signals Rds, Gds, Bds may have a different pulse width among one another. In this embodiment, the dimming signals Vdim_R, Vdim_G and Vdim_B may be preset to generate a desired white balance. R, G and B components of light are analyzed to obtain the desired white balance. The construction of the PWM controller 150 as shown in FIG. 6 may be implemented in a single IC and/or two ICs as long as the four operational amplifiers 154OP, 152OP-R, 152OP-G and 152OP-B are integrated.

Figure 4:
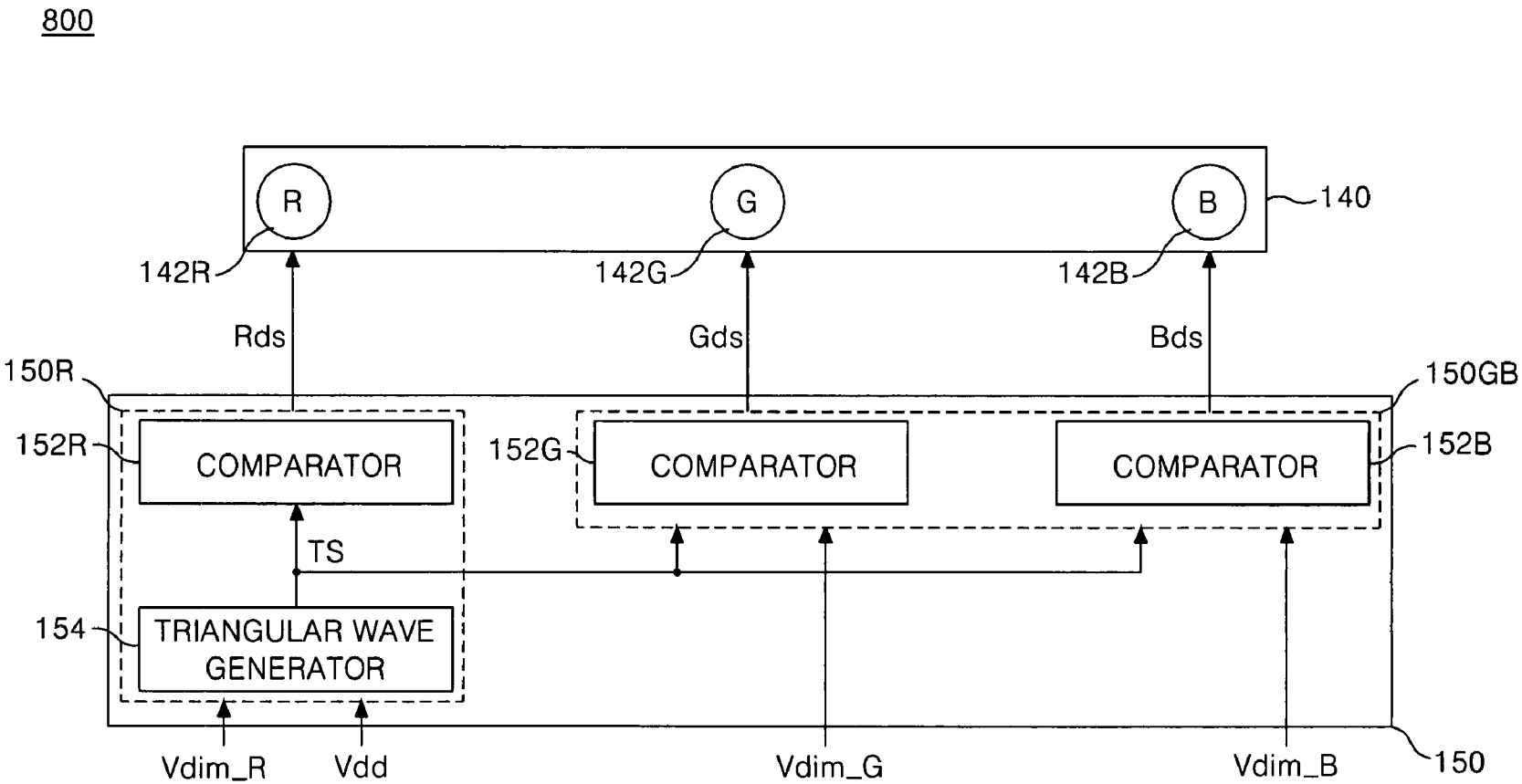
FIG. 4 is a diagram representing a backlight unit according to other embodiment.

In the backlight unit 100, the PWM controller 150 may include two ICs 150R and 150GB, as shown in FIG. 4. The PWM controller 150 of the backlight unit 100 has the common triangular wave generator 154 and the red comparator 152R integrated into the red PWM controller 150R, and the green comparator 152G of the green PWM controller 150G and the blue comparator 152B of the blue PWM controller 150B are integrated into one IC 150GB. Accordingly, the backlight unit 100 may have a reduced size due to the PWM controller 150. In other embodiment, the PWM controller may be implemented in a single IC as long as the IC includes a sufficient number of an operational amplifier.

Figure 7:
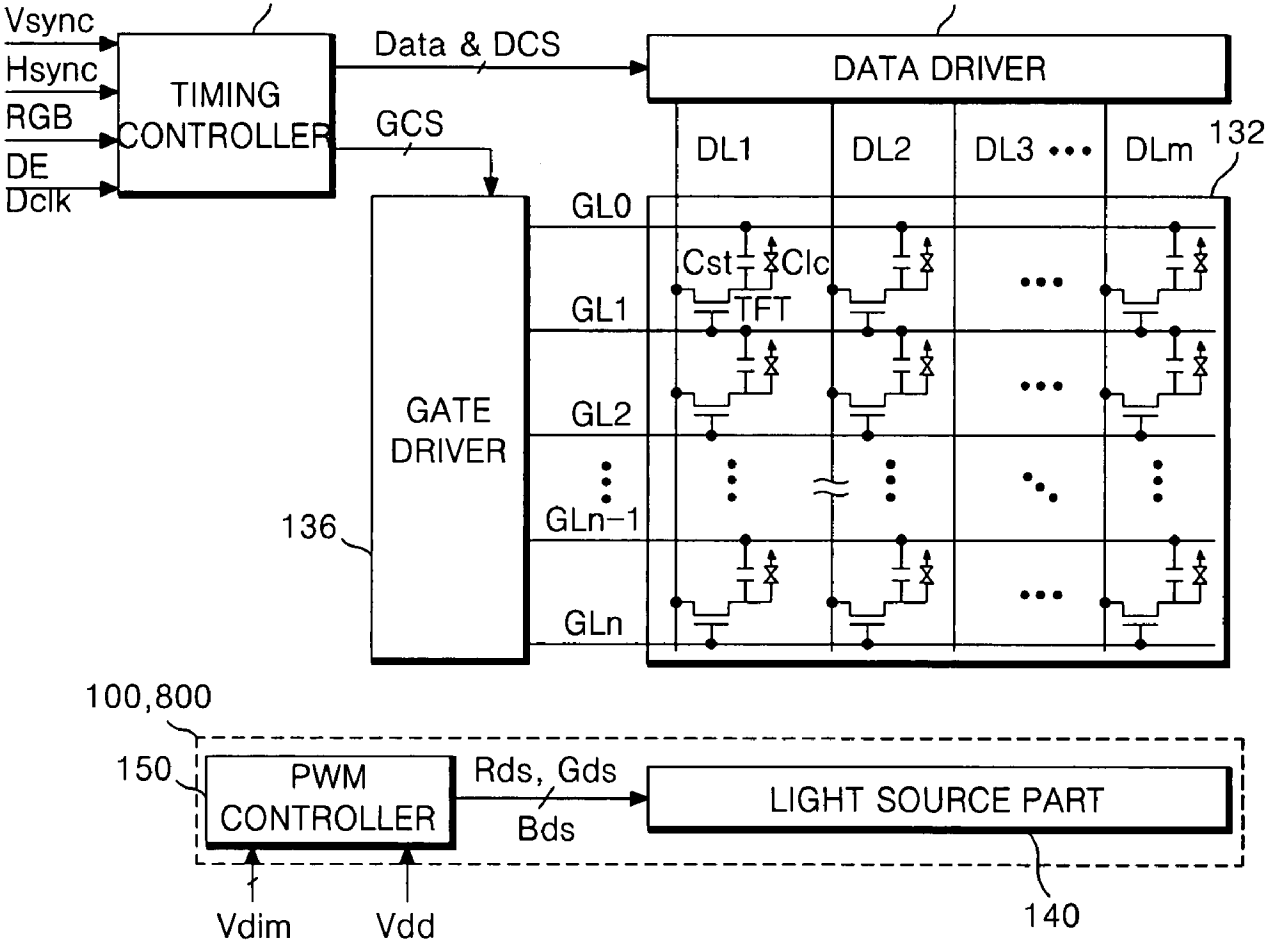
FIG. 7 is a diagram representing a liquid crystal display device using the backlight unit of FIG. 2.

FIG. 7 is a diagram of a liquid crystal display device 800 using a backlight unit 100, 800. Referring to FIG. 7, the liquid crystal display device includes a liquid crystal display panel 132; a data driver 134 to drive data lines DL1 to DLm of the liquid crystal display panel 132; a gate driver 136 to drive gate lines GL0 to GLn of the liquid crystal display panel 132; a timing controller 138 to control the data and gate drivers 134, 136; and the backlight unit 100, 800 to irradiate the liquid crystal display panel 132 with light.

The liquid crystal display panel 132 includes thin film transistors TFT of which each is formed at each intersection of the gate lines GL1 to GLn and the data lines DL1 to DLm. Liquid crystal cells are connected to the thin film transistors and arranged in a matrix shape.

The thin film transistor TFT responds to gate signals from the gate lines GL1 to GLn to supply data signals from the data lines DL1 to DLm to the liquid crystal cells. The liquid crystal cell includes a pixel electrode connected to the thin film transistor and a common electrode opposite to the pixel electrode with liquid crystal therebetween. The liquid crystal may include a liquid crystal capacitor Clc.

The timing controller 138 receives a dot clock Dclk, a horizontal synchronization signal Hsync, a vertical synchronization signal Vsync, a data enable DE and data RGB. The timing controller 138 re-arranges the data RGB to supply the data RGB to the data driver 134. The timing controller 138 generates data and gate control signals DCS, GCS to supply them to the data driver 134 and the gate driver 136 and controls the data driver 134 and the gate driver 136.

The gate driver 136 generates the gate signal in accordance with the gate control signal GCS from the timing controller 138 and sequentially supplies them to the gate lines GL1 to GLn. The data driver 134 converts the data supplied from the timing controller 138 into an analog data signal and supplies the data signals of one horizontal line to the data lines DL1 to DLm whenever the gate signal is supplied to the gate lines GL1 to GLn.

The backlight unit 100, 800 includes the light source part 140 having red, green and blue light sources and a pulse width modulator PWM controller 150 to drive the red, green and blue light sources. The backlight unit 100, 800 mixes the red, green and blue light colors from the light source part 140 to irradiate the liquid crystal display panel 132 with the white light. In this way, the liquid crystal display device 800 controls the transmittance of the white light which is irradiated to the liquid crystal display panel 132 from the light source part 140 of the backlight unit 100, 800, thereby displaying a desired picture.

As described above, the backlight unit and the liquid crystal display device using the same may reduce the size of the PWM controller by driving each of the red, green and blue light sources with the common triangular wave, which is generated by a single triangular generator. Further, the backlight unit and the liquid crystal display device using the same generate the red, green and blue light emitting driving signals, which are in synchronization with the common triangular wave, to drive each of the red, green and blue light sources. As a result, flickers may be substantially reduced.

The backlight unit may require no sensor such as an optical sensor, a temperature sensor, etc. and a simple structure is possible. Production expenses may be reduced and a compact design may be accomplished.

Although the invention has been explained by the embodiments shown in the drawings described above, it should be understood to the ordinary skilled person in the art that the invention is not limited to the embodiments. Various changes and/or modifications are possible without departing from the spirit of the invention. Accordingly, the scope of the invention shall be determined only by the appended claims and their equivalents.

What is claimed is:

1. A backlight unit, comprising:

a light source part having red, green and blue light sources; and a light source controller to generate a common control wave and drive each of the red, green and blue light sources based on a dimming signal and the common control wave, wherein the light source controller comprises;

a common triangular wave generator to generate the common triangular wave;

a red light source controller driving the red light source, wherein the a red light source controller includes a red comparator generating a red driving signal for driving the red light source based on the common control wave and the red dimming signal;

a green light source controller driving the green light source, wherein the green light source controller comprises a green comparator generating a green driving signal for driving the green light source with the common control wave and the green dimming signal; and a blue light source controller driving the blue light source, wherein the blue light source controller comprises a blue comparator generating a blue driving signal for driving the blue light source with the common control wave and the blue dimming signal, wherein the common triangular wave from the common triangular wave generator is commonly supplied to the red, green and blue comparators, wherein the red, green and blue light emitting driving signals are synchronized with each other by use of the common triangular wave.

2. The backlight unit according to claim 1, wherein the common triangular wave generator is embedded in one of the red light source controller, the green light source controller or the blue light source controller.

3. The backlight unit according to claim 2, wherein the common triangular wave generator, the red light source controller, the green light source controller and the blue light source controller are integrated into two integrated circuits.

4. The backlight unit according to claim 3, wherein the common triangular wave generator and the red light source controller are integrated into one integrated circuit and the green light controller and the blue light controller are integrated into the other integrated circuit.

5. A liquid crystal display device, comprising:

a liquid crystal display panel operable to display a picture by controlling light transmittance; and a backlight unit to irradiate the liquid crystal display panel with light, the backlight unit comprising a light source part having red, green and blue light sources, and a light source controller generating a common control wave and driving red, green and blue light sources with a dimming signal and the common control wave, wherein the light source controller comprises;

a common triangular wave generator to generate the common triangular wave;

a red light source controller driving the red light source, wherein the a red light source controller includes a red comparator generating a red driving signal for driving the red light source based on the common control wave and the red dimming signal;

green light source controller driving the green light source, wherein the green light source controller comprises a green comparator generating a green driving signal for driving the green light source with the common control wave and the green dimming signal; and a blue light source controller driving the blue light source, wherein the blue light source controller comprises a blue comparator generating a blue driving signal for driving the blue light source with the common control wave and the blue dimming signal, wherein the common triangular wave from the common triangular wave generator is commonly supplied to the red, green and blue comparators, wherein the red, green and blue light emitting driving signals are synchronized with each other by use of the common triangular wave.

6. The liquid crystal display device according to claim 5, wherein the common triangular wave generator is embedded in one of the red light source controller, the green light source controller and the blue light source controller.

7. The liquid crystal display device according to claim 6, wherein the common triangular wave generator, the red light source controller, the green light source controller and the blue light source controller are integrated into two integrated circuits.

8. The liquid crystal display device according to claim 7, wherein the common triangular wave generator and the red light source controller are integrated into one integrated circuit and the green light controller and the blue light controller are integrated into the other integrated circuit

9. The liquid crystal display device according to claim 5, wherein the plurality of light sources comprises red, green and blue light sources and the backlight unit operates to produce a white light by mixing the red, green and blue light sources.

* * * * *

UNITED STATES PATENT AND TRADEMARK OFFICE

CERTIFICATE OF CORRECTION

PATENT NO. : 7,580,016 B2
APPLICATION NO. : 11/208238
DATED : August 25, 2009
INVENTOR(S) : Byoung Chul Kim et al.

It is certified that error appears in the above-identified patent and that said Letters Patent is hereby corrected as shown below:

In column 6, claim 8, line 52, immediately after "integrated circuit" insert --.--.

Signed and Sealed this

Thirteenth Day of April, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,580,016 B2
APPLICATION NO. : 11/208238
DATED : August 25, 2009
INVENTOR(S) : Kim et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1392 days.

Signed and Sealed this

Fourteenth Day of September, 2010

David J. Kappos

David J. Kappos
*Director of the United States Patent and Trademark Office*